US005222638A

United States Patent [19]

Kolton et al.

[11] Patent Number: 5,222,638

[45] Date of Patent: Jun. 29, 1993

[54] HANGER FOR DUAL PRONG BELTS

[75] Inventors: Chester Kolton, Westfield; Stuart S. Spater, Livingston, both of N.J.

[73] Assignee: B&G Plastics, Inc., Newark, N.J.

[21] Appl. No.: 817,609

[22] Filed: Jan. 7, 1992

[51] Int. Cl.[5] ..... A47G 25/34; A47G 25/14

[52] U.S. Cl. ..... 223/87; 223/DIG. 1; 223/85

[58] Field of Search ..... 223/85, 87, DIG. 1; 206/293, 481, 480; 248/305, 301; 211/113, 13, 60.1, 71, 73

[56] References Cited

U.S. PATENT DOCUMENTS

| | | | |
|---|---|---|---|
| 1,687,581 | 10/1928 | Murphy | 211/113 |
| 2,401,835 | 6/1946 | McFall | 223/DIG. 1 |
| 3,378,180 | 4/1968 | Singer | 223/DIG. 1 |
| 3,710,996 | 1/1973 | Smilow et al. | 223/87 |
| 3,755,859 | 9/1973 | Solari | 223/85 X |
| 3,783,995 | 1/1974 | Tobin | 223/DIG. 1 X |
| 4,063,669 | 12/1977 | Smilow et al. | 223/87 |
| 4,416,401 | 11/1983 | King | 211/113 X |
| 4,453,655 | 6/1984 | Smilow et al. | 223/113 X |
| 4,930,692 | 6/1990 | Smilow et al. | 223/85 |

*Primary Examiner*—Clifford D. Crowder
*Assistant Examiner*—Bibhu Mohanty
*Attorney, Agent, or Firm*—Robin, Blecker, Daley & Driscoll

[57] ABSTRACT

A belt hanger comprised of a unitary body of a synthetic material has a hook portion and an elongate body portion depending from the hook portion, the body portion comprising a first part extending longitudinally thereof depending from the hook portion and having an opening therethrough, a belt prong-receiving part continuous with the body portion first part and a second part extending longitudinally of the body portion continuous with the prong-receiving part and having a projection thereon configured to seat in the opening of the body portion first part. The prong-receiving part defines a pair of prong residence openings mutually laterally spaced in respect of the body portion.

2 Claims, 2 Drawing Sheets

HANGER FOR DUAL PRONG BELTS

FIELD OF THE INVENTION

This invention relates generally to belt hangers and pertains more particularly to hangers accomodating the hanging of belts having buckles with plural prongs.

BACKGROUND OF THE INVENTION

Commonly-assigned U.S. Pat. Nos. 3,710,996 and 4,063,669 disclose belt hangers in widespread commercial use, comprising a unitary body of a synthetic material having a hook portion and a elongate body portion depending from the hook portion, the body portion comprising a first part extending longitudinally thereof depending from the hook portion and having an opening therethrough, a belt prong-receiving part contiguous with the body portion first part and a second part extending longitudinally of the body portion contiguous with the prong-receiving part and having a projection thereon configured to seat in the opening of the body portion first part.

The prong-receiving part defines a prong residence opening disposed at a fold line and a prong-entry slit communicates with the prong residence opening.

In assembling a belt with the referenced hangers, the hanger is dressed into the open frame of a belt buckle, with the prong distended outwardly of the buckle. The second hanger part is folded about the buckle and the projection thereon is snapped securely into the first hanger part opening. Then, the prong of the buckle is advanced through the prong-entry slit into the prong residence opening. A significant advantage of the referenced belt hangers is that the prong is secured in the hanger loop and is not in a position to mar adjacently-hung belts or buckles thereof.

Applicants note that the referenced hangers are ill-suited for the hanging of belts having buckles with dual prongs. Thus, if the hangers are used for the hanging of dual prong buckle belts, since they protectively retain only one prong, the other prong is exposed to be in position to mar the surface of adjacently-hung belts or buckles thereof.

In a further observation relative to dual prong buckle belts, applicants note that such belts have a wide variety of prong sizes and that the prong residence opening of the referenced hangers does not have capacity for accomodating the residence of the large end of such prong sizes.

SUMMARY OF THE INVENTION

The present invention has as its primary object the provision of hangers for the hanging of belts of type having buckles with plural prongs.

A more particular object of the invention is to provide dual prong buckle belt hangers having adaptiveness for the secured containment of prongs of a wide variety of sizes to preclude the occasion of damage to adjecently-hung belts or buckles thereof.

In attaining these and other objects the present invention provides a belt hanger comprised of a unitary body of a synthetic material having a hook portion and an elongate body portion depending from the hook portion, the body portion comprising a first part extending longitudinally thereof depending from the hook portion and having an opening therethrough, a belt prong-receiving part contiguous with the body portion first part and a second part extending longitudinally of the body portion contiguous with the prong-receiving part and having a projection thereon configured to seat in the opening of the body portion first part.

The prong-receiving part defines a pair of prong residence openings mutually laterally spaced in respect of the body portion and may include prong-entry slits extending longitudinally in the body portion respectively into communication with the prong residence openings.

In a particularly preferred embodiment, the prong-receiving part further defines slits extending laterally of the body portion into respective communication with the prong residence openings, whereby such openings may be expanded for accomodating larger-sized dual prongs.

In such particularly preferred embodiment, the body portion first part and the body portion second part are of a first thickness and the prong-receiving part is of a second thickness, the second thickness being less than the first thickness. The body portion first part and the prong-receiving part jointly define a first fold line and the body portion second part and the prong-receiving part jointly define a second fold line in the hanger.

The foregoing and other objects and features of the invention will be further understood from the following detailed description of a preferred embodiment thereof and from the drawings, wherein like reference numerals identify like components throughout.

DETAILED DESCRIPTION OF PREFERRED EMBODIMENTS

Figure 1:
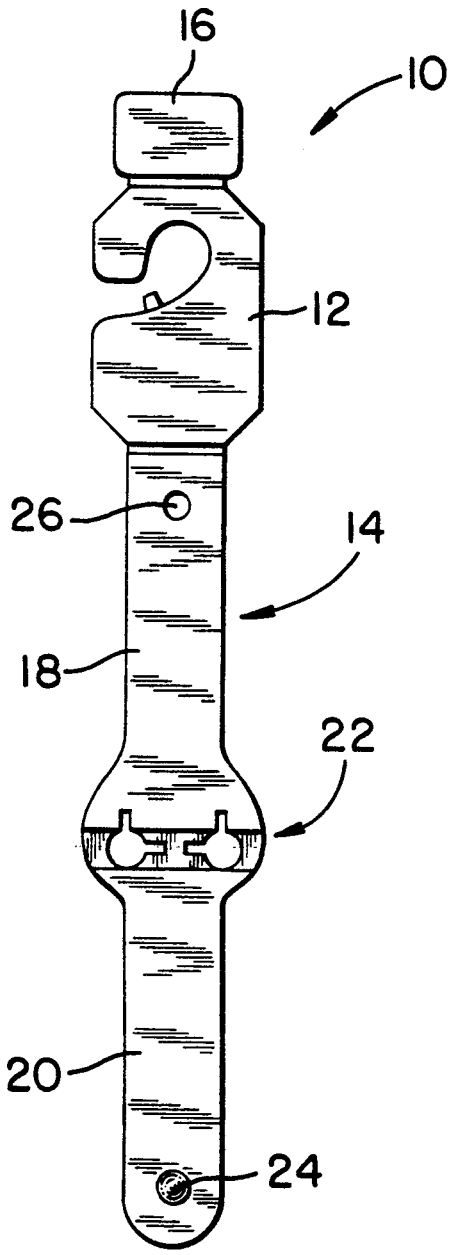
FIG. 1 is a front elevation of a hanger in accordance with the invention.
Figure 2:
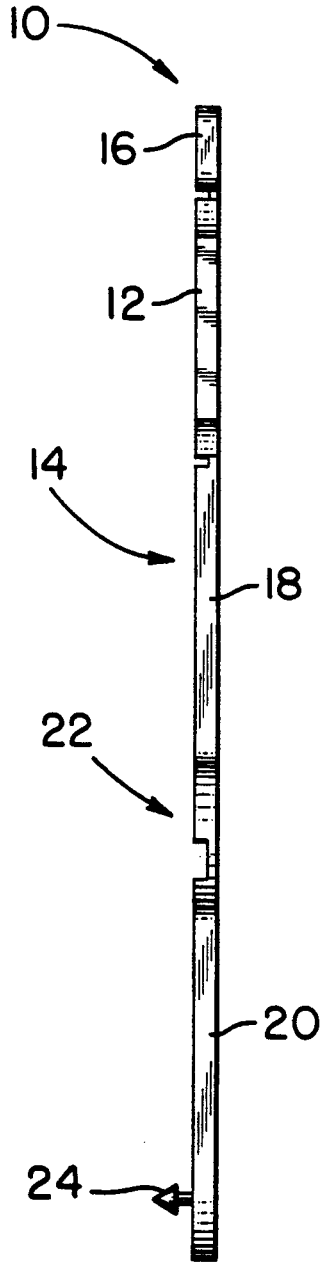
FIG. 2 is a right side elevation of the FIG. 1 hanger.

Referring to FIGS. 1 and 2, hanger 10 is a unitary structure comprised of molded synthetic material, having a hook portion 12 and a body portion 14 depending from the hook portion. Hook portion 12 may include an upper extension 16 for the display of marketing information, e.g., logo and/or size data.

Body portion 14 has a first elongate part 18 and a second elongate part 20, part 18 extending to and being continuous with prong-receiving part 22 and part 20 extending from and being continous with prong-receiving part 22.

Part 20 has projection 24 extending outwardly thereof and part 18 has an opening 26 configured to retentively receive projection 24 when part 20 is folded onto part 20.

Figure 3:
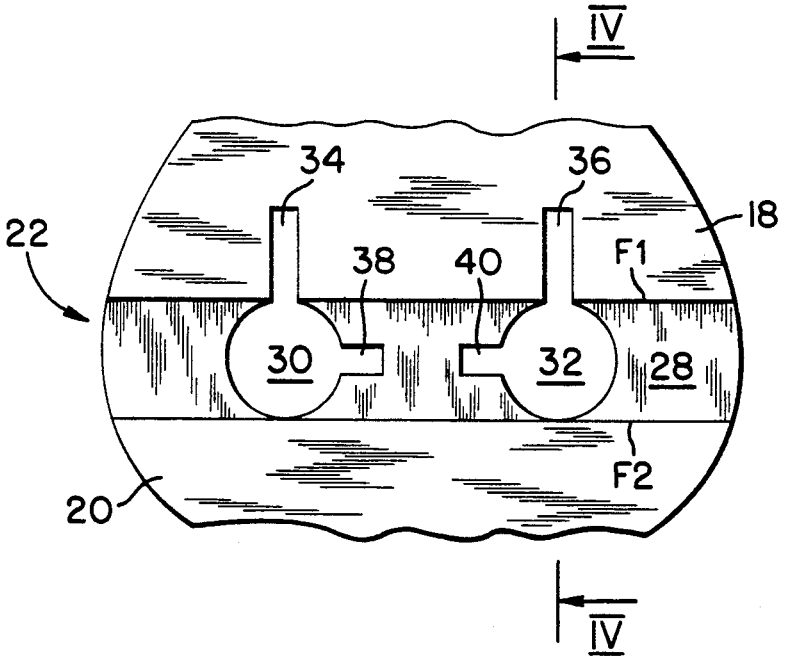
FIG. 3 is an enlarged partial front elevation of the hanger of FIG. 1.
Figure 4:
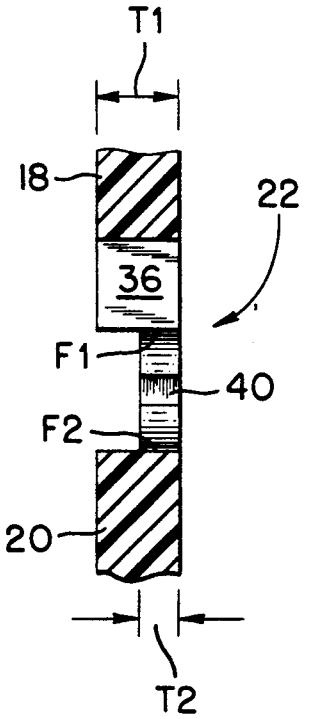
FIG. 4 is a sectional view as would be seen from plane IV—IV of FIG. 3.

Turning to FIGS. 3 and 4, prong-receiving part 22 includes flat expanse 28 through which extend prong residence openings 30 and 32. Body portion first part 20 defines slits 34 and 36, extending into communication with prong residence openings 30 and 32, respectively.

Body portion parts 18 and 20 are of common first thickness T1 (FIG. 4) and prong-receiving part 22 is of a second thickness T2, T2 being substantially less than T1, e.g., one-half or so thereof. By such thickness selection, applicants create fold lines F1, at the juncture of hanger body portion parts 18 and 22, and F2, at the juncture of hanger body portion parts 22 and 20. As is seen in FIG. 3, prong-residence openings 30 and 32 are longitudinally coextensive with expanse 28 of prong-receiving part 22.

As is further shown in FIG. 3, slits 38 and 40 are defined in expanse 28 of prong-receiving part 22, extending centrally outwardly into communication with prong residence openings 30 and 32. Whereas slits 34 and 36 serve as prong entry openings to prong residence openings 30 and 32, slits 38 and 40 serve a different purpose, namely, permitting expansion of openings 30 and 32 for accomodating residence of the larger sized dual prongs customary in some dual prong buckle belts.

Various changes in structure to the described hanger may evidently be introduced without departing from the invention. Accordingly, it is to be understood that the particularly disclosed and depicted embodiment is intended in a illustrative and not in a limiting sense. The true spirit and scope of the invention is set forth in the following claims.

What is claimed is:

1. A belt hanger comprised of a unitary body of a synthetic material having a hook portion and an elongate body portion depending from said hook portion, said body portion comprising a first part extending longitudinally thereof depending from said hook portion and having an opening therethrough, a belt prong-receiving part continuous with said body portion first part and a second part extending longitudinally of said body portion continuous with said prong-receiving part and having a projection thereon configured to seat in said opening of said body portion first part, said prong-receiving part defining a pair of prong residence openings mutually laterally spaced in respect of said body portion, first and second slits extending longitudinally of said body portion respectively into communication with said prong residence openings and third and fourth slits extending laterally of said body portion respectively into communication with said prong residence openings, said third and fourth slits having respective ends distal from said prong residence openings, said ends being spaced from one another by a portion of said prong-receiving part, said body portion first and second parts being of thickness exceeding that of said prong-receiving part.

2. The invention claimed in claim 1 wherein said body portion first part and said prong-receiving part jointly define a first fold line and wherein said body portion second part and said prong-receiving part jointly define a second fold line in said hanger.

* * * * *